US010174920B2

(12) United States Patent
Gibson

(10) Patent No.: US 10,174,920 B2
(45) Date of Patent: Jan. 8, 2019

(54) SAFETY DEVICE WITH LIGHTING ELEMENT AND MAGNETIC ATTACHMENT

(71) Applicant: John Gibson, Wynantskill, NY (US)

(72) Inventor: John Gibson, Wynantskill, NY (US)

( * ) Notice: Subject to any disclaimer, the term of this patent is extended or adjusted under 35 U.S.C. 154(b) by 0 days.

(21) Appl. No.: 15/599,784

(22) Filed: May 19, 2017

(65) Prior Publication Data

US 2017/0336059 A1 Nov. 23, 2017

Related U.S. Application Data

(60) Provisional application No. 62/339,280, filed on May 20, 2016.

(51) Int. Cl.

| | |
|---|---|
| ***F21V 21/096*** | (2006.01) |
| ***F21V 33/00*** | (2006.01) |
| ***F21V 14/02*** | (2006.01) |
| ***F21V 25/00*** | (2006.01) |
| ***F21L 4/02*** | (2006.01) |
| ***B66F 17/00*** | (2006.01) |
| ***B66F 7/28*** | (2006.01) |
| *F21W 131/402* | (2006.01) |

(52) U.S. Cl.

CPC ..... *F21V 21/096* (2013.01); *B66F 7/28* (2013.01); *B66F 17/00* (2013.01); *F21L 4/02* (2013.01); *F21V 14/02* (2013.01); *F21V 25/00* (2013.01); *F21V 33/0076* (2013.01); *F21W 2131/402* (2013.01)

(58) Field of Classification Search

CPC ..... F21V 33/0076; F21V 21/096; F21V 21/0965; B66F 17/00; B66F 17/003; B66F 17/006

See application file for complete search history.

(56) References Cited

U.S. PATENT DOCUMENTS

| | | | | |
|---|---|---|---|---|
| 2,690,271 | A | 9/1954 | Marietta | |
| 3,561,628 | A | 2/1971 | Melin | |
| 3,757,898 | A | 9/1973 | Mitchell et al. | |
| 5,575,608 | A | 11/1996 | Yau et al. | |
| 5,639,072 | A | 6/1997 | McCall | |
| 6,242,070 | B1 | 6/2001 | Gillispie et al. | |
| 6,471,465 | B2 | 10/2002 | Albertyn | |
| 7,014,905 | B1 | 3/2006 | Linton | |
| 7,225,900 | B2 | 6/2007 | Fox | |
| 7,267,199 | B2 | 9/2007 | Farrara et al. | |
| 7,950,706 | B2 | 5/2011 | Shaw et al. | |
| 8,147,087 | B2 * | 4/2012 | Chen | F21V 21/0965 362/184 |
| 8,251,553 | B2 | 8/2012 | Dantas | |
| 8,287,146 | B2 | 10/2012 | Hysky | |
| 8,816,806 | B2 * | 8/2014 | Tait | H01F 7/021 335/285 |
| 8,998,460 | B2 | 4/2015 | Dantas | |
| 9,638,379 | B2 * | 5/2017 | Sun | F21L 4/04 |

(Continued)

*Primary Examiner* — Robert J May

(74) *Attorney, Agent, or Firm* — Schmeiser, Olsen & Watts, LLP

(57) ABSTRACT

A safety device including a side wall, a receiving area defined by the side wall, at least one magnet disposed within the receiving area, and at least one lighting element disposed on the side wall, wherein, the receiving area receives a portion of a structure when the plurality of magnets magnetically interact with the portion of the structure, is provided. Furthermore, an associated method is also provided.

11 Claims, 6 Drawing Sheets

(56) References Cited

U.S. PATENT DOCUMENTS

| | | | | |
|---|---|---|---|---|
| 2007/0236921 | A1* | 10/2007 | Mosholder, Jr. ..... | F21S 8/00<br>362/158 |
| 2009/0183952 | A1 | 7/2009 | Alford | |
| 2011/0249430 | A1* | 10/2011 | Stamatatos ..... | B60Q 1/2615<br>362/184 |

* cited by examiner

SAFETY DEVICE WITH LIGHTING ELEMENT AND MAGNETIC ATTACHMENT

CROSS-REFERENCE TO RELATED APPLICATIONS

This application claims priority to and the benefit of U.S. Provisional Application No. 62/339,280 filed May 20, 2016, and entitled "Lift Assembly Safety Device With Lighting Element and Magnetic Attachment," the entire contents of which are hereby incorporated by reference.

FIELD OF TECHNOLOGY

The following relates to a safety device, and more specifically to embodiments of a padded section magnetically attached to a structure, such as a lift assembly.

BACKGROUND

Lift assemblies, such as a lift for a vehicle, are designed to raise the vehicle a significant distance off the ground for access to the underside of a vehicle. When the vehicle is in a lift position, a person may walk or crouch underneath the vehicle to perform work on the vehicle, inspect the vehicle, and the like. Due to height of the lift assembly when in a lift position, a person moving around near the lift assembly is susceptible to bumping their head. This can cause major head trauma, or simple annoyance. Nonetheless, it is a safety hazard, which is increased due to poor lighting underneath the lift assembly or similar structures.

Thus, a need exists for an apparatus and method for addressing the safety hazard posed by lift assemblies when in a lift position.

SUMMARY

A first aspect relates generally to a padded safety device for a lift assembly.

A second aspect relates generally to a safety device comprising: a side wall, a receiving area defined by the side wall, at least one magnet disposed within the receiving area, and at least one lighting element disposed on the side wall, wherein, the receiving area receives a portion of a structure when the plurality of magnets magnetically interact with the portion of the structure.

A third aspect relates generally to a padded safety device attached to a lift assembly, the padded safety device comprising: a receiving area, the receiving area defined by a side wall that extends continuously around a perimeter of the padded safety device, leaving a gap between a first edge of the side wall and a second edge of the side wall, a plurality of magnets, the plurality of magnets being paired with the padded safety device via attachment to a base located within the padded safety device, wherein the plurality of magnets magnetically attach the padded safety device to a surface of the lift assembly, and a plurality of lighting elements, the plurality of lighting elements being removably coupled to the side wall at various locations around the perimeter of the padded safety device, wherein the plurality of lighting elements emit light into a space located underneath the lift assembly to increase a visibility of a user in the space located underneath the lift assembly, wherein the padded safety device cushions a collision between the user and the lift assembly when the user is working underneath the lift assembly A fourth aspect relates generally to a method for increasing a safety and a visibility near a lift assembly, the method comprising: attaching a padded safety device to the lift assembly, the padded safety device including a receiving area, the receiving area defined by a side wall that extends continuously around a perimeter of the padded safety device, leaving a gap between a first edge of the side wall and a second edge of the side wall, a plurality of magnets, the plurality of magnets being embedded into a receiving surface of the receiving area, such that the magnets are flush with the receiving surface, wherein the plurality of magnets magnetically attach the padded safety device to a surface of the lift assembly, and a plurality of lighting elements, the plurality of lighting elements being removably coupled to the side wall at various locations around the perimeter of the padded safety device, and emitting light from the plurality of lighting elements into a space located underneath the lift assembly to increase the visibility of a user in the space located underneath the lift assembly, wherein the padded safety device cushions a collision between the user and the lift assembly when the user is working underneath the lift assembly to increase the safety near the lift assembly The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

Figure 1:
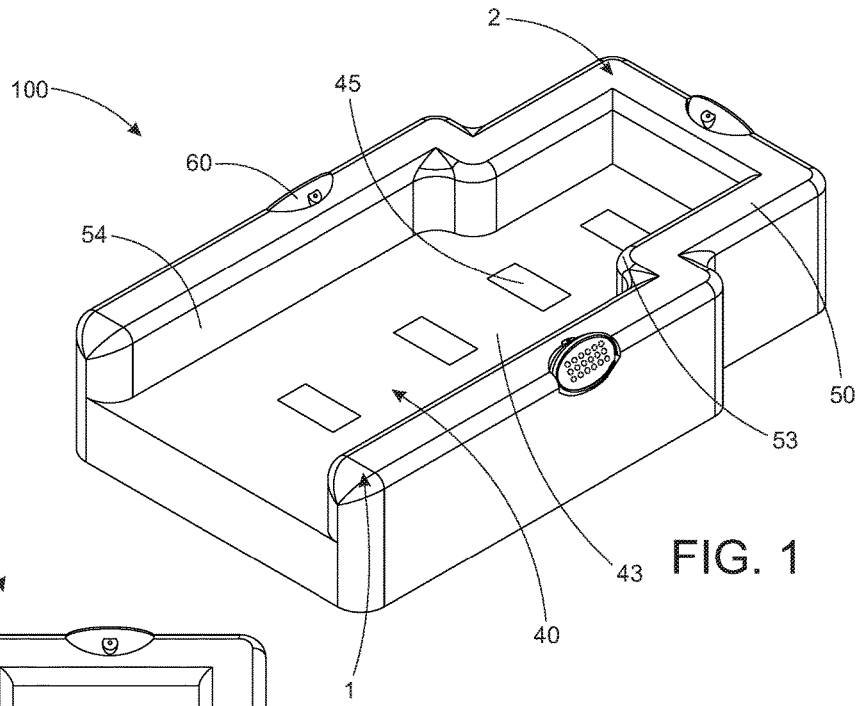
FIG. 1 depicts a front, top perspective view of an embodiment of a safety device.
Figure 2:
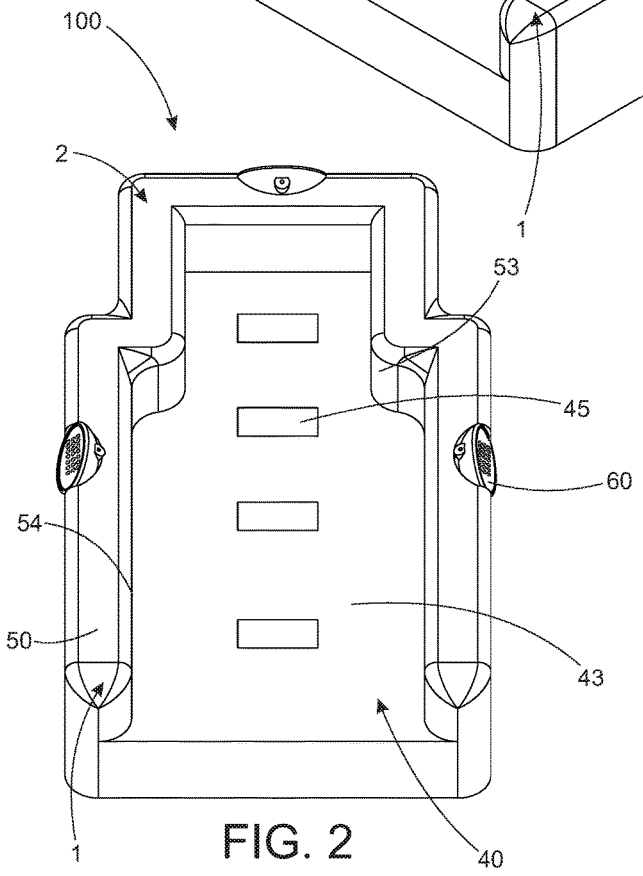
FIG. 2 depicts an elevated front view of an embodiment of the safety device.
Figure 3:
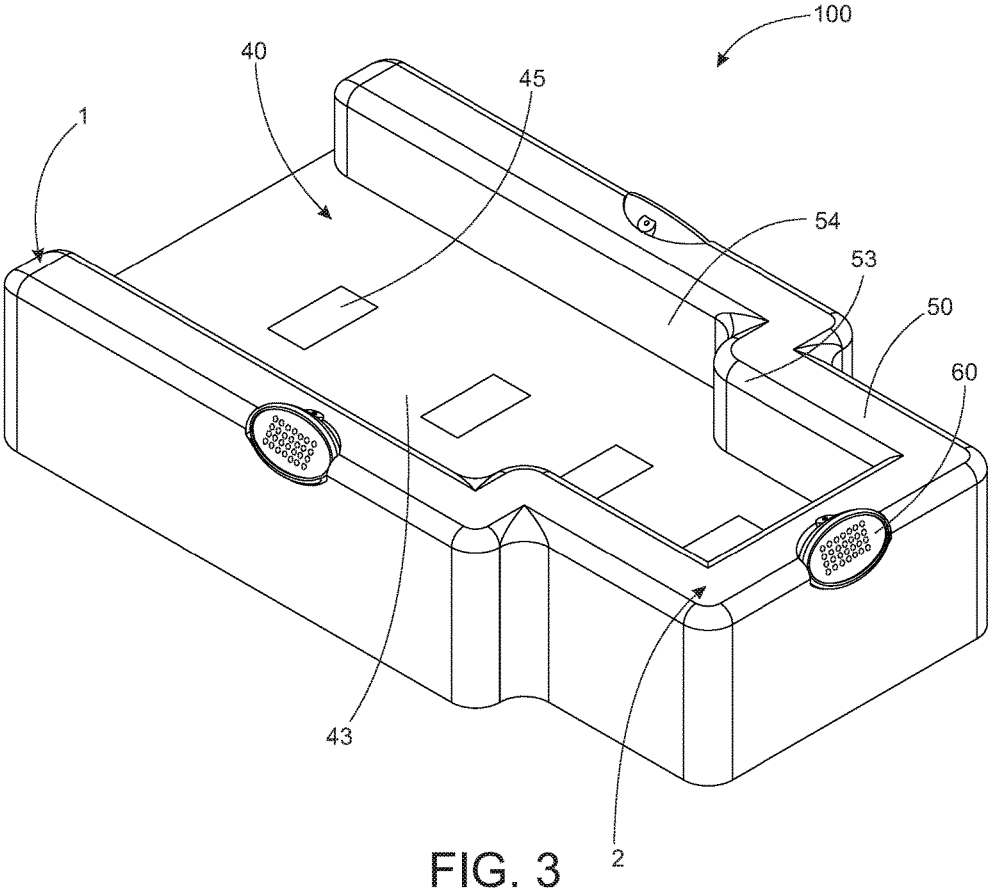
FIG. 3 depicts a rear, perspective view of an embodiment of the safety device.
Figure 4:
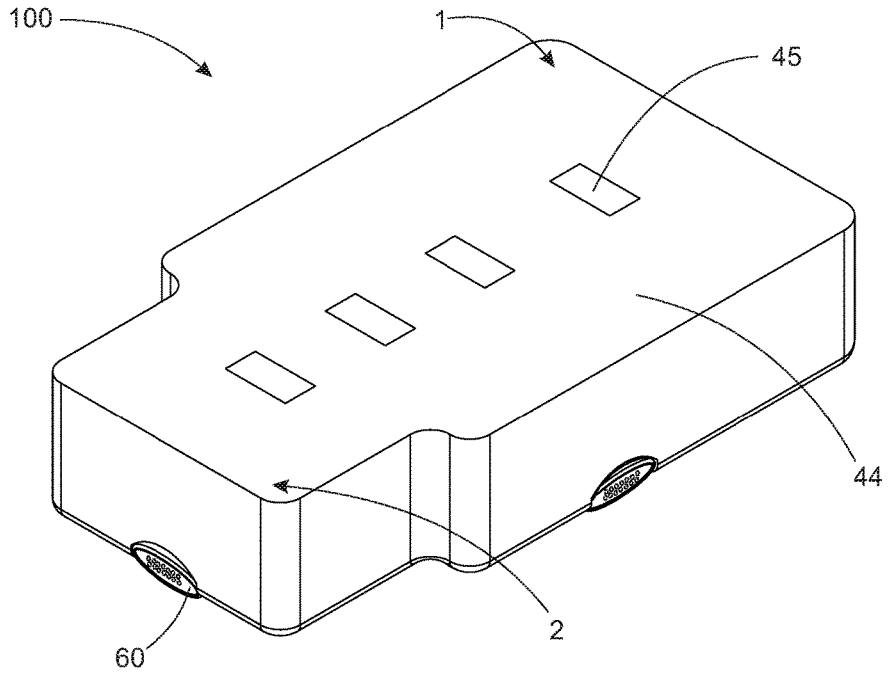
FIG. 4 depicts an elevated rear, bottom view of an embodiment of the safety device.

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Referring to the drawings, FIGS. 1-4 depict an embodiment of a safety device 100. Embodiments of the safety device 100 may be a padded section, a bumper, a guard, a safety device, a padded device, a cushion, a protective cushion, a foam element, a safety pad, a lift assembly safety device, and the like. Embodiments of the safety device 100 may be configured to be attached to a portion of a lift assembly or similar structure. A lift assembly may be a car lift, a truck lift, a motorcycle lift, a jack lift, a two-post lift, a four-post lift, a storage lift, an auto lift, a hydraulic lift, an automotive lift, a portable lift, a specialty lift, or any device that is configured to raise an object and has exposed structural members with a possibility to be a safety hazard. In other embodiments, the safety device 100 may be configured to attach to object and/or structural members other than for a lift assembly, such as a post, beam, rafter, joist, and the like. Embodiments of the safety device 100 may magnetically couple/attach to the lift assembly or other structure provided the lift assembly or other structure that is attracted to magnets, such as ferromagnetic material. In cases where the structural member is not attracted to magnets, the safety device 100 may be coupled thereto via a physical interference fit. Further, embodiments of the safety device 100 may be comprised of a padding material, a cushioning material, a foam material, a conformal material, and the like, and combinations thereof.

Embodiments of the safety device 100 may include a first end 1, a second end 2, a receiving area 40, at least one magnet 45, and at least one lighting element 60. Embodiments of the safety device 100 may include a side wall 54, a receiving area 40 defined by the side wall 54, at least one magnet 45 disposed within the receiving area 40, and at least one lighting element 60 disposed on the side wall 54, wherein the receiving area 40 receives a portion of a structure when the at least one magnet magnetically interacts with the portion of the structure.

Embodiments of the safety device 100 may include a side wall 54 that forms an outer edge of the safety device 100. The side wall 54 may project upwards from a receiving surface 43 a distance to form a wall-like edge. A thickness of the side wall 54 may vary, but the thicker the side wall 54, the more cushioning may be provided to cushion against a user bumping their head against the safety device 100. For instance, the safety device 100 may be a padded section configured to attach to a portion of a lift assembly, wherein the padded section is increased by an increased thickness of the side wall 54. Furthermore, the side wall 54 may define a receiving area 40 located between the side wall 54; a height of the side wall 54 may determine a depth of the receiving area 40, which may vary depending on the structure for which the safety device 100 may be attached to.

With continued reference to FIGS. 1-4, embodiments of the safety device 100 may include a receiving area 40. Embodiments of the receiving area 40 may be an area, a cavity, a channel, a receptacle, a void, an opening, a recessed portion, a recessed area, and the like. The receiving are 40 may accommodate, receive, and/or partially surround a portion of a structural member of a lift assembly or similar structure. For example, when in a mated position with the lift assembly or other structure, a portion of the lift assembly or other structure may be received within the receiving area 40, which may prevent direct contact with a user's head and the lift assembly structure. In an exemplary embodiment, the first end 1 and the second end 2 may have an open end so that the receiving area 40 extends through each end. However, in other embodiments, the second end 2 may be a closed end, wherein the side wall 54 extends continuously from a first side of the device 100 at the first end 1 to the first end 1 of the opposing side of the device 100. The closed end proximate the second end 2 may be useful for corners or edges of the lift assembly or other structure. Moreover, proximate the second end 2 of the safety device 100, the receiving area 40 may be reduced. The reduction in width of the receiving area 40 may be defined by an internal lip 53 of the side wall 54. In some embodiments, the side wall 54 may project inwardly to reduce a distance between the side wall 54 on one side of the device 100 and the side wall 54 on the opposing side of the device 100. The internal lip 53 may be present on embodiments with an open end and a closed end. Embodiments of the internal lip 53 may define a step or surface that is perpendicular to the side wall 54, or may taper inwardly to provide a gradual reduction in the receiving area 40.

Figure 5:
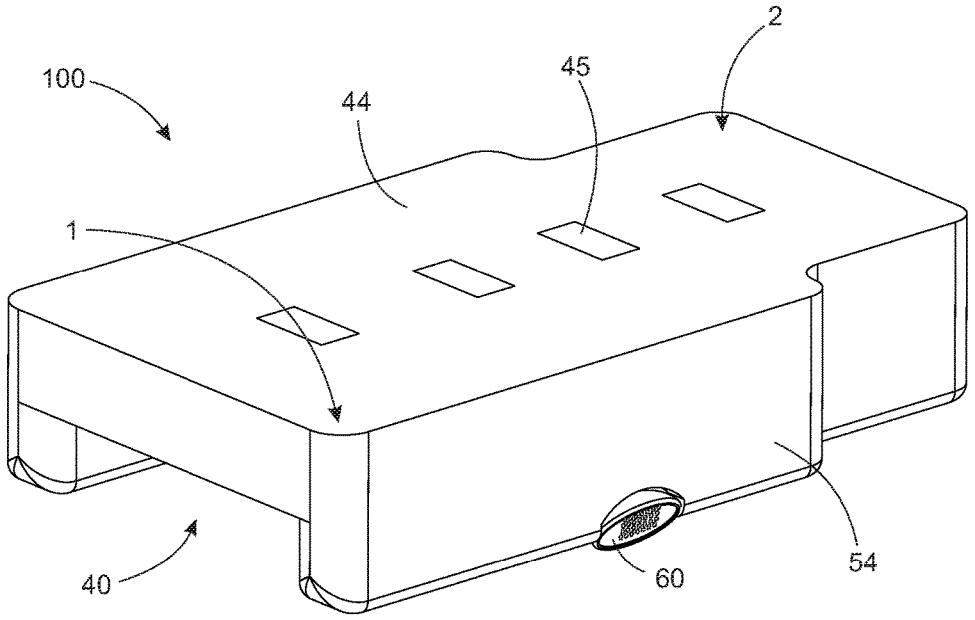
FIG. 5 depicts a front, bottom perspective view of the safety device.

Furthermore, embodiments of the safety device 100 may include at least one magnet 45 for magnetic attachment to the lift assembly or other structure. In some embodiments, the safety device 100 may include a plurality of magnets 45. In an exemplary embodiment, the device 100 may include four magnets 45. Embodiments of the magnets 45 may be disposed along a receiving surface 43 of the receiving area 40. The magnets 45 may be equally spaced apart, but may also be disposed proximate the ends 1, 2 only, at the center only, or at the ends 1, 2 and the center of the receiving area 40. One or more magnets 45 may also be placed at one or more of the corners of the device 100. Further, at least a portion of the magnets 45 may be embedded within the safety device 100. In an exemplary embodiment, the magnets 45 may be embedded within the device 100 such that a magnet surface is flush with the receiving surface 43. In yet another embodiment, the magnets 45 may be inserted within the device 100 such that the magnets 45 are flush with the receiving surface 43 and flush with a bottom surface 44, as shown in FIG. 5. In an alternative embodiment, the magnets 45 may be raised a distance from the receiving surface 43 and/or bottom surface 44. Embodiments of the safety device 100 may have one or magnets 45 exposed on the bottom surface 44 for attaching magnetically to a flat surface, such as a flat portion of the lift assembly, for storage or holding purposes when not attached to a lift arm of the lift assembly.

Figure 6A:
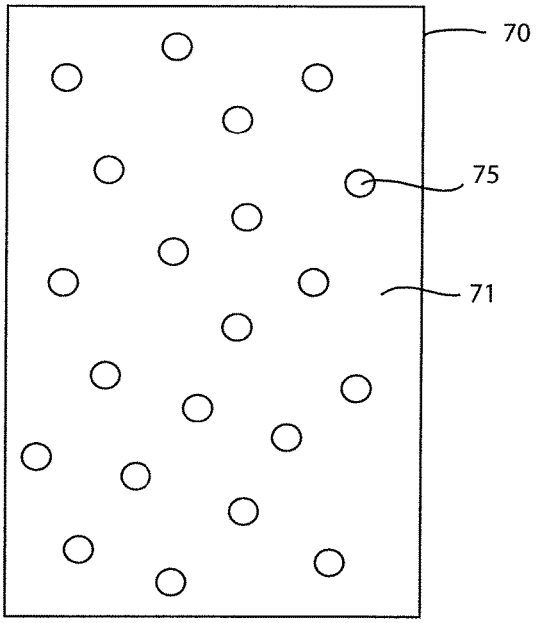
FIG. 6A depicts a top view of an embodiment of a base.
Figure 6B:
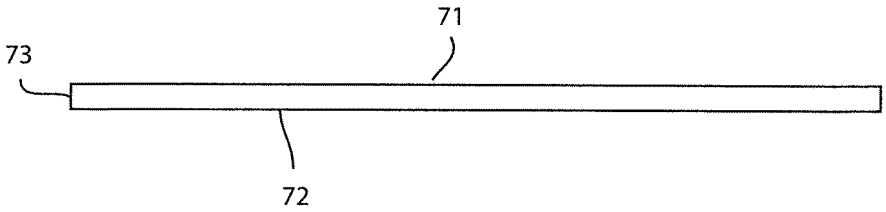
FIG. 6B depicts a side view of an embodiment of the base.
Figure 6C:
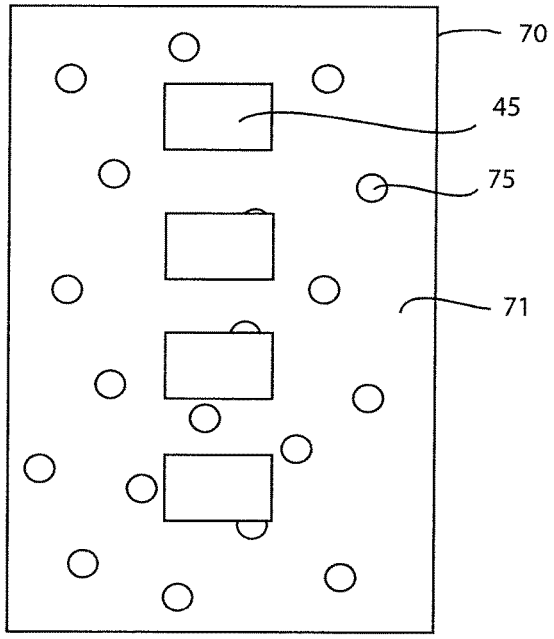
FIG. 6C depicts a top view of an embodiment the base with at least one magnet attached to the base.
Figure 6D:
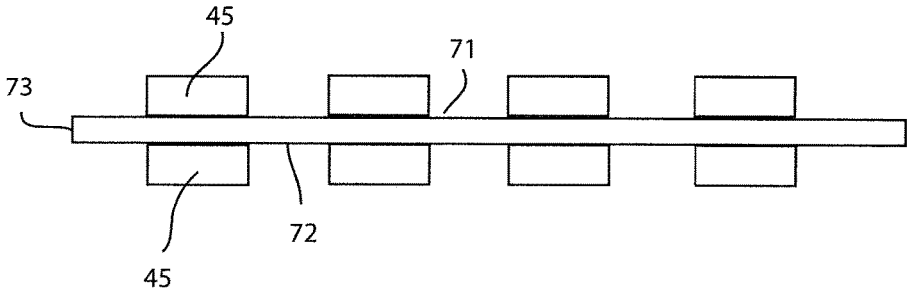
FIG. 6D depicts a side view of an embodiment of the base having magnets attached to both side of the base.

The magnets 45 may be disposed within the device 100 via interference fit, or may be adhered to the device 100, or otherwise operably coupled to the device 100. In an exemplary embodiment, a foam material is poured into a mold around the magnets 45. Referring to FIGS. 6A-6D, embodiments of the safety device 100 may include a base 70. Embodiments of the base 40 may be a base, a manufacturing base, a substrate, a magnet support device, a magnet attachment device, a sheet, a plastic sheet, and the like. In an exemplary embodiment, the base 40 may be a clear polycarbonate sheet, or similar sheet of material that may be cut to a desired size, for example, sized and dimensioned to fit within a perimeter of the side wall 54 of the safety device 100. Embodiments of the base 40 may include a plurality of holes 75. Embodiments of the holes 45 may be an opening, a through-hole, a bore, a tunnel, and passageway, and the like. Embodiments of the holes 75 may allow a foam material to pass therethrough during the manufacturing process when the foam material is introduced into a mold. Further, embodiments of the base 70 may have a thickness 73. The thickness 73 may vary, but may be thin in some embodiments. For example, the base 70 may have a thickness 73 of 0.090 inches-0.2 inches, or greater than 0.2 inches, or less than 0.9 inches. As shown in FIGS. 6C-6D, magnets 45 may be operably coupled to the base 70 on a first side 71 and/or second side 72 of the base 70. The magnets 45 may be permanently coupled to the sides of the 71, 72 of the base 70. The magnets 45 may for example be adhered, glued, fastened, and the like to the base 70, prior to entering a mold. In an exemplary embodiments, the magnets 45 coupled to the base 70 on the first side 71 may be aligned with the magnets 45 coupled to the base 70 on the second side 70, as shown in FIG. 6D.

Accordingly, one or more magnets 45 may be coupled to, embedded with, located within, or otherwise paired with a foam or other cushion type material, using base 70 in a molding process. For instance, one or magnets 45 may be attached to the base 70, and then the base 70 with the magnets 45 attached may be placed within a mold. The mold may be a manufacturing mold that allows a pouring of flowable contents into the mold which fills the void in the mold to take the shape of the mold, for example. As the flowable material, which may be a material used to create foam or other cushion material when heated, is poured into the mold, the flowable material surrounds the base 70 and the magnets 45, passing through the openings 75 to further integrate the foam material with the base 70, filling the mold. When the molding process is complete, the resultant product may be removed and the magnets 75 may be embedded or otherwise located into the foam or cushion material, while being fastened to the base 70 covered within by the foam or cushion material. The technique of using a base 70 and attaching magnets 45 to a base 70 may be used for manufacturing any article that seeks to pair a magnet material with a foam or other cushion material.

Referring back to FIGS. 1-5, embodiments of the safety device 100 may also include at least one lighting element 60 operably coupled to the safety device 100. Embodiments of the lighting element 60 may be a light source. Embodiments of at least one lighting element 60 may be a light bulb, a LED light, a track light, incandescent light, fluorescent light, such as compact fluorescent light (CFL), high-intensity discharge light, or any light source capable of emitting light and being operably coupled to the safety device 100. In an exemplary embodiment, the lighting element 60 may be coupled to the side wall 54. The lighting element 60 may be partially embedded within a side wall 54 of the safety device 100. Moreover, embodiments of the safety device 100 may include a plurality of lighting elements 60. In one embodiment, the safety device 100 may include three lighting elements 60. The lighting elements 60 may be positioned anywhere along the side wall 54 of the device 100, and may face away from the device 100 so as to illuminate an area proximate or below the lift assembly. In an exemplary embodiment, at least one lighting element 60 may be positioned on each side of the device. In further embodiments, a lighting element 60 may also be positioned proximate, at, or otherwise near the second end 2 of the device if the side wall 54 is continuous. Even further embodiments of the device 100 may include one or more lighting elements 60 positioned on or partially embedded within the bottom surface 44 of the device 100. Alternatively, the lighting elements 60 may be positioned/embedded within the side wall 54 so that they are flush with the surface of the side wall 54. Embodiments of the lighting element 60 may be battery powered, or may be connected to a remote power source. In some embodiments, the remote power source may be contained within the device 100, or attached to the device 100 for replacing the battery. Further, embodiments of the lighting elements 60 may be removably attached to the device 100 so that they can be removed for battery replacement. Each of the lighting elements 60 may include a switch to power on/off, or a central switch may be provided to turn the lighting elements 60 on/off.

Moreover, embodiments of the lighting element 60 may be pivotable to adjust an angle between the side wall 54 and the front of the lighting element 60. The pivotable action of the lighting elements 60 may allow a user to direct or focus light on a particular location underneath the structure. In an exemplary embodiment, a pivotable lighting element may include an axle or a rod extending partially into the side wall 54 on either side of a cutout in the side wall that accepts the lighting element 60, which passes through a bore located on the lighting element 60 to allow a pivoting action.

Figure 7:
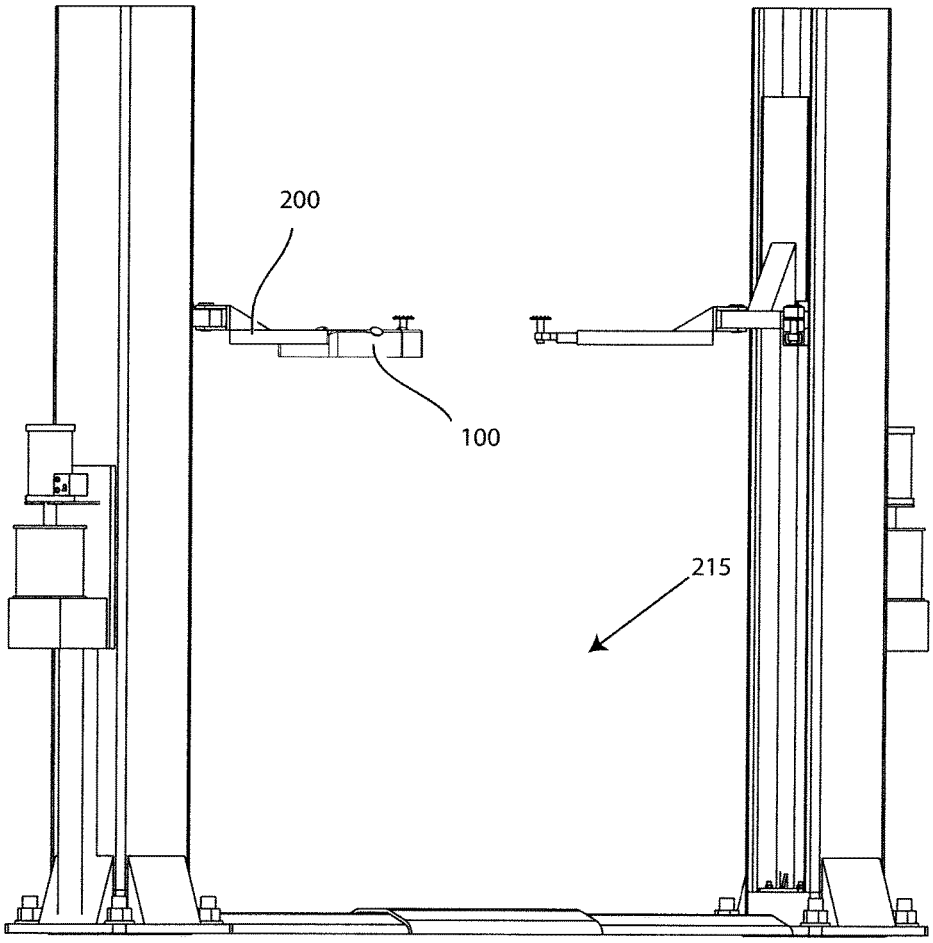
FIG. 7 depicts an embodiment of the safety device attached to a lift assembly.

FIG. 7 depicts an embodiment of the safety device 100 attached to a lift assembly 200. The manner in which the safety device 100 may be used will now be described. Embodiments of the safety device 100 may be placed, by a user, onto a portion of the lift assembly 200 or other post, beam, or structural member. When the device 100 is placed into engagement with the structure 200, the one or more magnets 45 can magnetically attach the device 100 to the portion of the structure 200 such that the device 100 may not fall off or otherwise result in unwanted disengagement. Because of the magnetic attachment of the device 100, the device 100 may be placed at any location on the structure 200 determined to be a safety hazard. A portion of the structure 200 may be received within the receiving area 40, which may increase the surface area or number of sides of the structure covered by the device 100. For added safety and workability, the lighting elements 60 may be turned on to illuminate the lift assembly 200 as well as a workspace 215 underneath or proximate the lift assembly 200.

Referring now to FIGS. 1-6, a method for increasing a safety near a lift assembly may include the steps of positioning a safety device 100 on a lift assembly, the safety device 100 including a side wall 54, a receiving area 40 defined by the side wall 54, at least one magnet 45 disposed within the receiving area 40, and at least one lighting element 60 disposed on the side wall 54, wherein, the receiving area 40 receives a portion of the lift assembly when at least one magnet 45 magnetically interacts with the portion of the lift assembly.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A padded safety device attached to a lift assembly, the padded safety device comprising:

a receiving area, the receiving area defined by a side wall that extends continuously around a perimeter of the padded safety device, leaving a gap between a first edge of the side wall and a second edge of the side wall;

a plurality of magnets, the plurality of magnets being paired with the padded safety device via attachment to a base located within the padded safety device, wherein the plurality of magnets magnetically attach the padded safety device to a surface of the lift assembly; and a plurality of lighting elements, the plurality of lighting elements being removably coupled to the side wall at various locations around the perimeter of the padded safety device, wherein the plurality of lighting elements emit light into a space located underneath the lift assembly to increase a visibility of a user in the space located underneath the lift assembly;

wherein the padded safety device cushions a collision between the user and the lift assembly when the user is working underneath the lift assembly.

2. The padded safety device of claim 1, wherein the plurality of lighting elements are independently pivotable to focus a light being emitted from a lighting element onto a workpiece underneath the lift assembly.

3. The padded safety device of claim 1, wherein the plurality of magnets are exposed on a bottom surface, the bottom surface being on an opposite side of the padded safety device than the receiving surface.

4. The padded safety device of claim 1, further comprising an internal lip extending inwardly into the receiving area to reduce a size of the receiving area.

5. The padded safety device of claim 1, wherein additional lighting elements are disposed on a bottom surface of the padded safety.

6. The padded safety device of claim 1, wherein the plurality of magnets are disposed along a shared axis, in a center of the receiving area.

7. A method for increasing a safety and a visibility near a lift assembly, the method comprising:

attaching a padded safety device to the lift assembly, the padded safety device including a receiving area, the receiving area defined by a side wall that extends continuously around a perimeter of the padded safety device, leaving a gap between a first edge of the side wall and a second edge of the side wall, a plurality of magnets, the plurality of magnets being embedded into a receiving surface of the receiving area, such that the magnets are flush with the receiving surface, wherein the plurality of magnets magnetically attach the padded safety device to a surface of the lift assembly, and a plurality of lighting elements, the plurality of lighting elements being removably coupled to the side wall at various locations around the perimeter of the padded safety device; and emitting light from the plurality of lighting elements into a space located underneath the lift assembly to increase the visibility of a user in the space located underneath the lift assembly;

wherein the padded safety device cushions a collision between the user and the lift assembly when the user is working underneath the lift assembly to increase the safety near the lift assembly.

8. The method of claim 7, wherein the plurality of lighting elements are independently pivotable to focus a light being emitted from a lighting element onto a workpiece underneath the lift assembly.

9. The method of claim 7, wherein the plurality of magnets are exposed on a bottom surface, the bottom surface being on an opposite side of the padded safety device than the receiving surface.

10. The method of claim 7, wherein additional lighting elements are disposed on a bottom surface of the padded safety.

11. The method of claim 7, wherein the plurality of magnets are disposed along a shared axis, in a center of the receiving area.

* * * * *